US010928154B1

(12) United States Patent
Kam

(10) Patent No.: US 10,928,154 B1
(45) Date of Patent: Feb. 23, 2021

(54) TOY PROJECTILE LAUNCHER WITH HYBRID MANUAL AND ELASTIC POWERED LAUNCHING MECHANISMS

(71) Applicant: Ao Jie Plastic Toys Factory Ltd., Kwun Tong (HK)

(72) Inventor: Chi Hang Kam, Kwun Tong (HK)

(73) Assignee: Ao Jie Plastic Toys Factory Ltd., Kwun Tong (HK)

( * ) Notice: Subject to any disclaimer, the term of this patent is extended or adjusted under 35 U.S.C. 154(b) by 0 days.

(21) Appl. No.: 16/576,764

(22) Filed: Sep. 19, 2019

(51) Int. Cl.

| | |
|---|---|
| ***F41B 7/00*** | (2006.01) |
| ***F41B 11/00*** | (2013.01) |
| ***F41B 5/14*** | (2006.01) |
| ***F41B 5/00*** | (2006.01) |
| ***F41B 11/642*** | (2013.01) |

(52) U.S. Cl.
CPC ..... *F41B 5/0094* (2013.01); *F41B 7/00* (2013.01); *F41B 11/642* (2013.01)

(58) Field of Classification Search
CPC .... F41B 5/0026; F41B 5/0052; F41B 5/0094; F41B 5/14; F41B 5/1411; F41B 7/00; F41B 7/08; F41B 11/64; F41B 11/642; F41B 11/89
USPC ... 124/16, 17, 23.1, 56, 65, 66, 67, 24.1, 64
See application file for complete search history.

(56) References Cited

U.S. PATENT DOCUMENTS 2,069,821 A * 2/1937 Douglas ..... F41B 11/00 124/67
2,214,224 A * 9/1940 Douglas ..... F41B 11/51 124/67
3,957,027 A * 5/1976 Drake ..... F41B 5/0026 124/23.1
4,086,901 A * 5/1978 Clement ..... F41B 3/02 124/21
4,625,706 A * 12/1986 Turner, Jr. ..... F42B 6/00 124/22
D337,796 S * 7/1993 Sutyak ..... D21/571
5,224,464 A * 7/1993 Burnham ..... F41B 7/00 124/16
5,242,323 A * 9/1993 Rappaport ..... F41B 11/642 124/63
5,253,873 A * 10/1993 Grattan ..... F41B 7/00 124/16
5,678,528 A * 10/1997 Hadley ..... F41B 5/12 124/24.1
5,711,284 A * 1/1998 Keenan, Jr. ..... F41B 5/14 124/49

(Continued)

*Primary Examiner* — Alexander R Niconovich

(74) *Attorney, Agent, or Firm* — LaHorte & Associates P.C.

(57) ABSTRACT

A projectile launcher that toy ball projectiles. The projectile launcher has a launch tube and a slide tube that interconnect in a telescoping manner. A handle is affixed to the free end of the slide tube. The handle is free to rotate relative the launch tube. In this manner, the handle can be rotated while the slide tube telescopes with the launch tube. A bow structure is affixed to the launch tube. The bow structure has opposing arms that extend away from the launch tube in the manner of an archery bow. An elastic bow string extends between the free ends of the bow structure arms and the handle. During use, a toy ball projectile is positioned in the launch tube. The slide tube is retracted relative the launch tube. The movement of the slide tube stretches the elastic bow string and biases the slide tube forward.

18 Claims, 5 Drawing Sheets

(56) References Cited

U.S. PATENT DOCUMENTS

| | | | | |
|---|---|---|---|---|
| 6,076,513 | A * | 6/2000 | Doherty | F41B 11/642 124/66 |
| 6,499,478 | B1 * | 12/2002 | Perez | F41B 5/14 124/25.6 |
| 6,997,770 | B2 * | 2/2006 | Lapointe | F41B 11/00 124/66 |
| 8,485,171 | B2 * | 7/2013 | Romney | F41B 5/14 124/65 |
| 8,505,524 | B2 * | 8/2013 | Lyon | F41B 5/14 124/24.1 |
| 8,991,374 | B1 * | 3/2015 | Conkel | F41B 5/14 124/24.1 |
| 9,261,322 | B1 * | 2/2016 | Conkel | F41B 7/006 |
| 9,341,422 | B2 * | 5/2016 | Rodich | F41B 5/00 |
| 9,513,075 | B2 * | 12/2016 | Lallier | F41A 9/73 |
| D832,370 | S | 10/2018 | Chen | |
| D832,939 | S | 11/2018 | Chen | |
| 2007/0193571 | A1 * | 8/2007 | Moss | F41B 5/14 124/88 |
| 2009/0050128 | A1 * | 2/2009 | Mitchell | F41B 5/0031 124/66 |
| 2015/0059720 | A1 * | 3/2015 | Barber | F41B 5/1403 124/23.1 |

* cited by examiner

TOY PROJECTILE LAUNCHER WITH HYBRID MANUAL AND ELASTIC POWERED LAUNCHING MECHANISMS

BACKGROUND OF THE INVENTION

1. Field of the Invention

In general, the present invention relates to toy projectile launchers that project foam balls into flight. More particularly, the present invention relates to the structure of toy projectile launchers and the mechanisms for powering the projectile launcher.

2. Prior Art Description

Toy projectile launchers in the form of toy guns, toy bows, and toy crossbows have existed for centuries. Toy projectile launchers utilize a variety of mechanisms to launch projectiles into flight. For example, a toy bow and arrow would typically use a string to launch an arrow into flight. A toy dart gun would typically use a compressed spring to launch a toy dart into flight. If the toy projectile is a lightweight ball, such as a foam ball, pneumatics are typically used to launch the projectile into flight. The ball projectible is typically positioned at the end of a tube. A piston is then moved in the tube to create pneumatic pressure. The pneumatic pressure forces the ball out of the tube with enough velocity for the toy ball to fly toward a target. Such toys are commonly referred to as pop guns in the toy industry.

In the toy industry, it is not unusual for different projectile launching systems to be combined within a toy. For example, there are several instances in the prior art where a pneumatic launching mechanism is combined with a string launching mechanism in a toy that launches a toy projectile. Such prior art hybrid launch systems are exemplified by U.S. Pat. No. 2,069,821 to Douglas and U.S. Pat. No. 5,224,464 to Burnham.

Combining a string launching system with a pneumatic launching system enables a child to provide greater velocity to the projectile than would be available through use of either a string system or a pneumatic system alone. However, the toy becomes more complex to use and more difficult to control.

A need therefore exists for an improved toy projectile launcher that combines a bow string launching system with a pneumatic launching system, yet can be adjusted across a range of launch velocities. This need is met by the present invention as described and claimed below.

SUMMARY OF THE INVENTION

The present invention is a projectile launcher that both pneumatically and mechanically launches toy ball projectiles. The projectile launcher has a launch tube and a slide tube that interconnect in a telescoping manner so that the relative movement of the slide tube and the launch tube creates a change of air pressure within the launch tube.

A handle is affixed to the free end of the slide tube. Although the handle is attached to the slide tube and the slide tube is attached to the launch tube, the handle is free to rotate relative the launch tube. In this manner, the handle can be rotated while the slide tube telescopes with the launch tube.

A bow structure is affixed to the launch tube. The bow structure has opposing arms that extend away from the launch tube in the manner of an archery bow. An elastic bow string extends between the free ends of the bow structure arms and the handle. Two separate elastic strings can be used, or one elastic bow string that passes through a conduit in the handle.

During use, a toy ball projectile is positioned in the launch tube. The slide tube is retracted relative the launch tube. The movement of the slide tube stretches the elastic bow string and biases the slide tube forward. The tension in the elastic bow string can be selectively increased by turning the handle and partially winding the elastic bow string on the handle. The handle is then manually pushed toward the launch tube. This movement is assisted by the elastic bow string. The movement of the slide tube creates an increase in air pressure within the launch tube, therein launching the toy ball projectile from the launch tube.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy projectile launcher can be embodied in many ways, only one exemplary embodiment of the present is illustrated and described. The exemplary embodiment has been selected in order to set forth one of the best modes contemplated for the invention. The illustrated embodiment, however, is merely exemplary and should not be considered a limitation when interpreting the scope of the appended claims.

Figure 1:
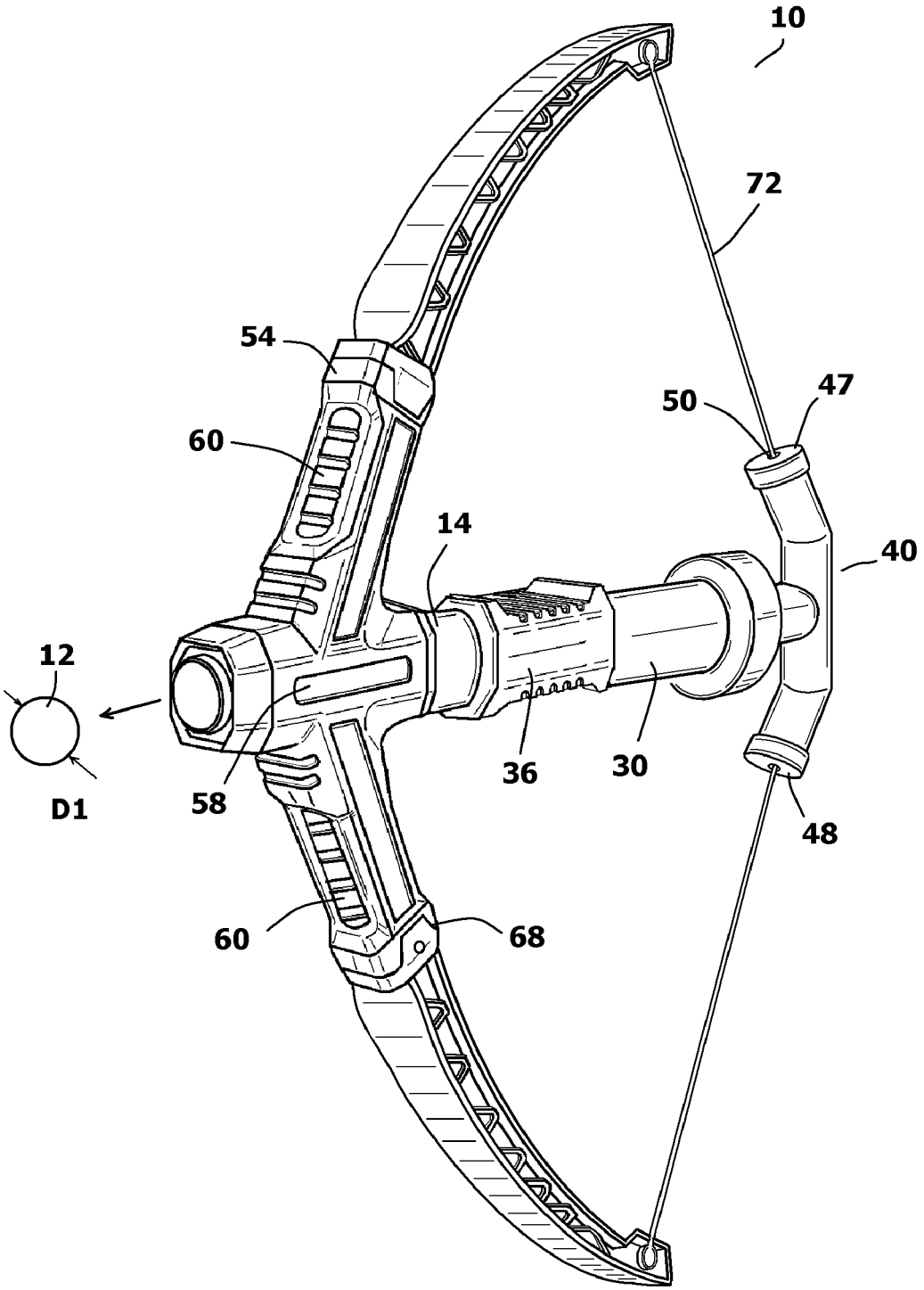
FIG. 1 is a perspective view of an exemplary embodiment of a projectile launcher with toy ball projectiles.
Figure 2:
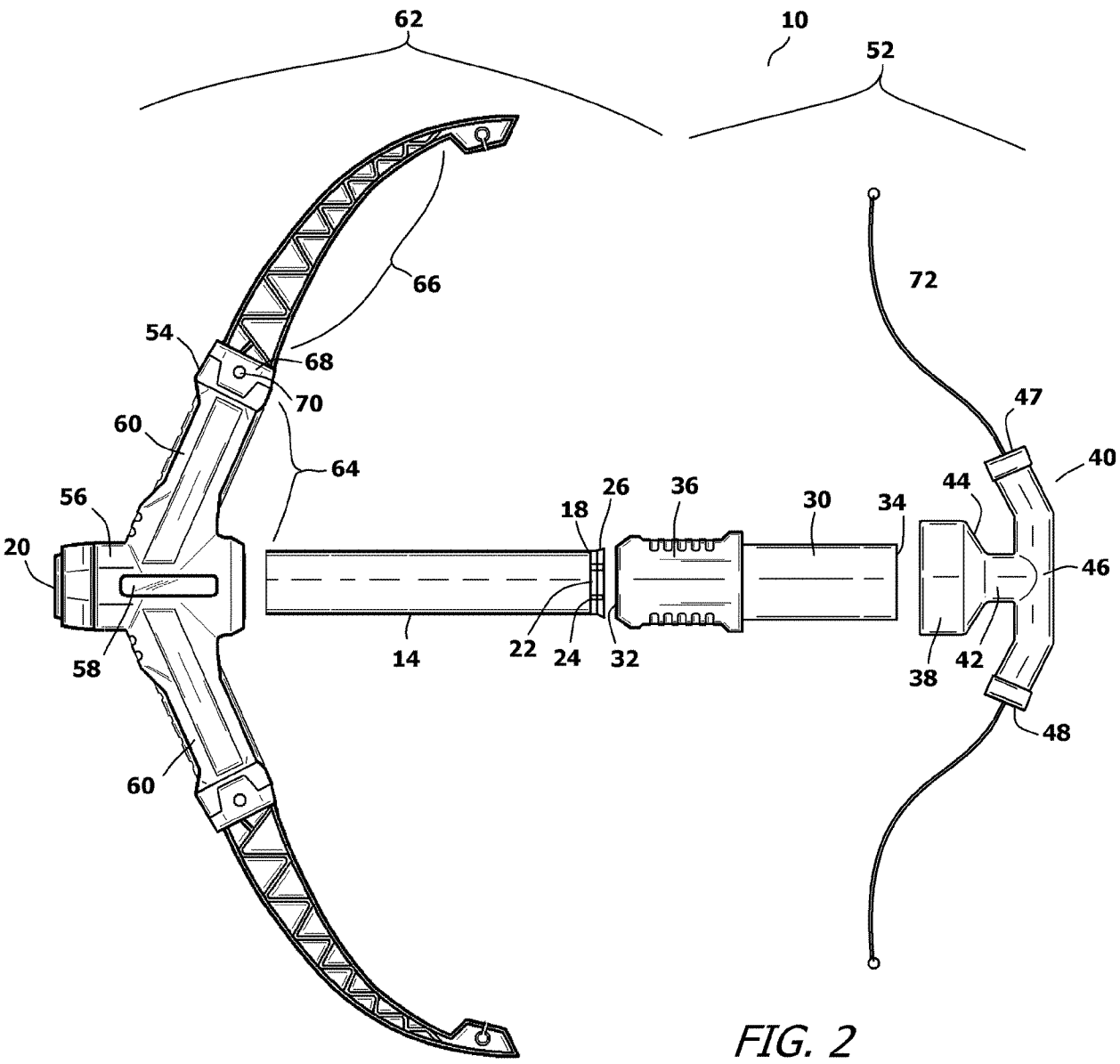
FIG. 2 is an exploded view of the embodiment of FIG. 1.

Referring to FIG. 1 and FIG. 2, a toy projectile launcher 10 is shown. The toy projectile launcher 10 is designed to launch toy ball projectiles 12 that have a first diameter D1. The toy projectile launcher 10 is a hybrid launcher that embodies a bowstring launch mechanism integrated with a pneumatic launch mechanism. The pneumatic launch mechanism includes a launch tube 14. The launch tube 14 has an inner diameter that extends between a first end 16 and an opposite second end 18. The inner diameter is larger than the diameter D1 of the toy ball projectiles 12. The first end 16 of the launch tube 14 is open. A restriction ring 20 is mounted to the first end 16 of the launch tube 14. The restriction ring 20 has an inner diameter that is slightly smaller than the diameter D1 of the toy ball projectiles 12.

The second end 18 of the launch tube 14 terminates with a stop 22. The stop 22 contains small vent holes 24 that enable a small volume of air to pass through the stop 22 at the second end 18 of the launch tube 14. A tube seal 26 is also affixed to the stop 22 outside of the launch tube 14. The tube seal 26 and the second end 18 of the launch tube 14 are received within a wider slide tube 30 in a telescoping manner. The tube seal 26 on the launch tube 14 creates an air seal against the interior of the slide tube 30.

The slide tube 30 has a first end 32 and an opposite second end 34. The first end 32 is open and receives the second end 18 of the launch tube 14. A pump handle 36 is affixed to the slide tube 30 near its open first end 32. The slide tube 30 does not obstruct the open first end 32. The opposite second end 34 of the slide tube 30 is sealed closed by a T-handle construct 40. The T-handle construct 40 has a base 38 that seals the second end 34 of the slide tube 30, yet retains its ability to rotate relative the slide tube 30. A neck 42 extends from the center of the base 38 and is able to rotate relative the slide tube 30 with the base 38. The base 38 has a beveled surface 44 that leads into the neck 42. The beveled surface 44 is smooth and has an angle of inclination relative the slide tube 30, the purpose of which is later explained. The neck 42 interconnects the base 38 to a tubular handle 46. The tubular handle 46 is curved between a first end 47 and a second end 48. The tubular handle 46 defines a conduit 50 that extends from the first end 47 to the second end 48.

From the above, it will be understood that the pump handle 36 is affixed to the slide tube 30 near its first end 32 and the T-handle construct 40 is affixed to the slide tube 30 at its second end 48. This creates a slide subassembly 52. The slide subassembly 52 can reciprocally slide along the launch tube 14. As the slide subassembly 52 is retracted, air is drawn through the launch tube 14 and into the slide tube 30 through the vent holes 24 in the stop 22 of the launch tube 14. As the slide subassembly 52 is advanced over the launch tube 14, the slide subassembly 52 displaces air into the launch tube 14 through the vent holes 24, therein increasing the air pressure within the launch tube 14. The slide subassembly 52 can be manually engaged and moved relative the launch tube 14 using either the pump handle 36 or the T-handle construct 40.

A bow structure 54 is affixed to the launch tube 14. The bow structure 54 has a core section 56 that mounts to the exterior of the launch tube 14. The launch tube 14 is translucent. A window 58 is formed in the core section 56 so that the toy ball projectiles 12 can be observed within the core section 56. Two arms 60 extend from the core section 56 in opposite directions to complete the bow structure 54. The bow structure 54 is affixed to the launch tube 14. As such, the bow structure 54 and the launch tube 14 form a rigid bow subassembly 62, wherein the slide subassembly 52 can move relative the bow subassembly 62.

The arms 60 of the bow structure 54 can be rigid. However, in the shown embodiment, the arms 60 are foldable between an inner first section 64 and an outer second section 66. The inner first section 64 of each arm 60 is rigidly affixed to the core section 56. The outer second section 66 of each arm 60 is attached to the inner first section 64 at hinge joints 68. The hinge joints 68 enable the outer second section 66 of each arm 60 to move between a folded configuration (FIG. 4) and an extended configuration (FIG. 1). A locking mechanism 70 is provided at each hinge joint that can be used to lock the outer second section 66 of each arm 60 in either the folded configuration or the extended configuration.

An elastic bow string 72 is affixed to the arms 60 at the distal ends of the outer second sections 66. The elastic bow string 72 extends through the conduit 50 in the tubular handle 46 of the slide subassembly 52. When the arms 60 of the bow structure 54 are extended, the elastic bow string 72 is in tension and biases the slide subassembly 52 toward the launch tube 14. The tension in the elastic bow string 72 increases as the slide subassembly 52 is manually retracted along the launch tube 14.

Toy ball projectiles 12 are provided. The toy ball projectiles 12 are preferably made of a polymeric foam and are compressible. The toy ball projectiles 12 have a diameter D1, but can be forced through the smaller diameter restriction ring 20 at the first end 16 of the launch tube 14. The toy ball projectiles 12 are used to fill or partially fill the launch tube 14.

Figure 3:
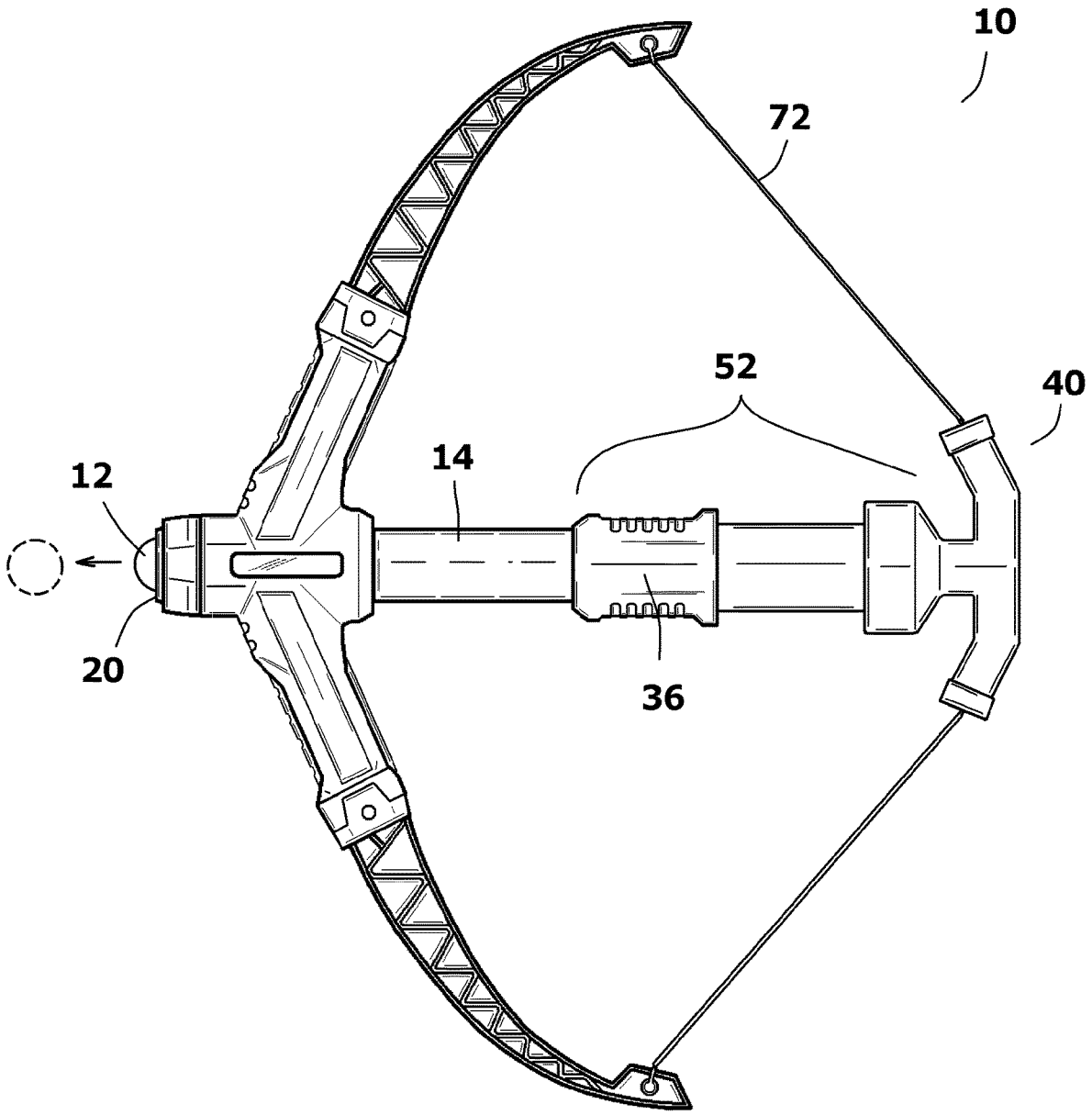
FIG. 3 shows the exemplary projectile launcher in a fully cocked configuration.

Referring to FIG. 3 in conjunction with FIG. 2, it can be seen that to fire the toy projectile launcher 10, the slide subassembly 52 is manually retracted using the pump handle 36 and/or the T-handle construct 40 on the slide subassembly 52. As the slide subassembly 52 is retracted, the elastic bow string 72 is stretched and acts against the movement. Additionally, air is drawn into the slide tube 30 through the launch tube 14.

Once the slide subassembly 52 is fully or partially retracted, the projectile launcher 10 is cocked and ready to fire. To fire, a user manually moves the slide subassembly 52 forward. The tension in the elastic bow string 72 helps in this movement. This movement of the slide subassembly 52 displaces air out of the slide tube 30 and into the second end 18 of the launch tube 14. The movement of air moves the toy ball projectiles 12 toward the restriction ring 20 at the first end 16 of the launch tube 14. The toy ball projectile 12 then wedges in the restriction ring 20, creating a blockage. The air pressure in the launch tube 14 increase behind the blockage as the slide subassembly 52 is advanced. The pressure increases until it is sufficient to deform the toy ball projectile 12 and force the toy ball projectile 12 through the restriction ring 20 and into flight. The process can then be repeated until all of the toy ball projectiles 12 are displaced out of the launch tube 14.

Figure 4:
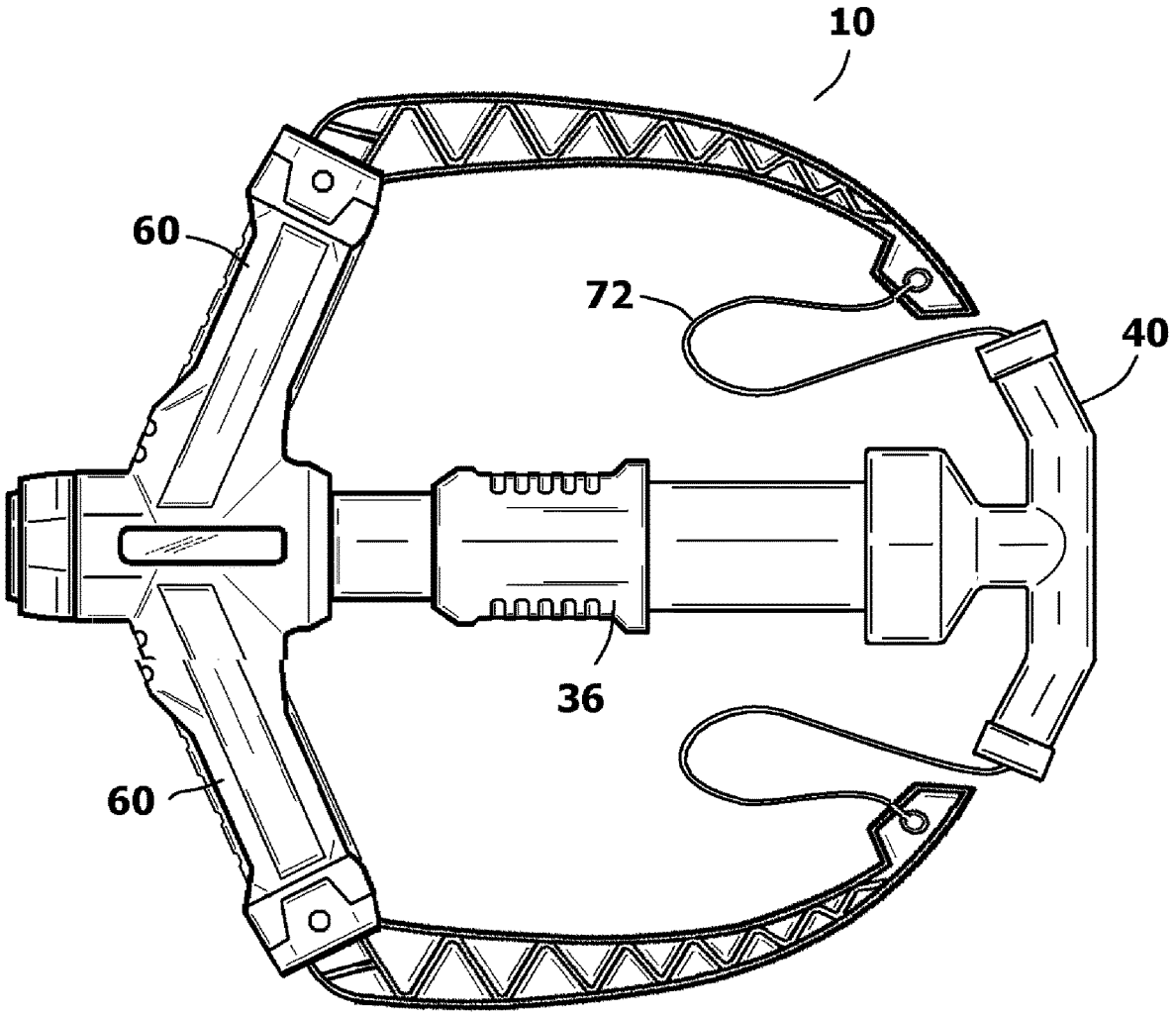
FIG. 4 shows the exemplary projectile launcher in a folded configuration.

Referring to FIG. 4 in conjunction with FIG. 2, it can be seen that the arms 60 of the bow structure 54 can be oriented into their folded configuration. Once in the folded configuration, the elastic bow string 72 becomes slack. The toy projectile launcher 10 can then be operated as a traditional pop gun with the only operating force being applied manually to the pump handle 36 and/or the T-handle construct 40. The elastic bow string 72 remains slack and inert throughout the operational movement of the slide subassembly 52.

Figure 5:
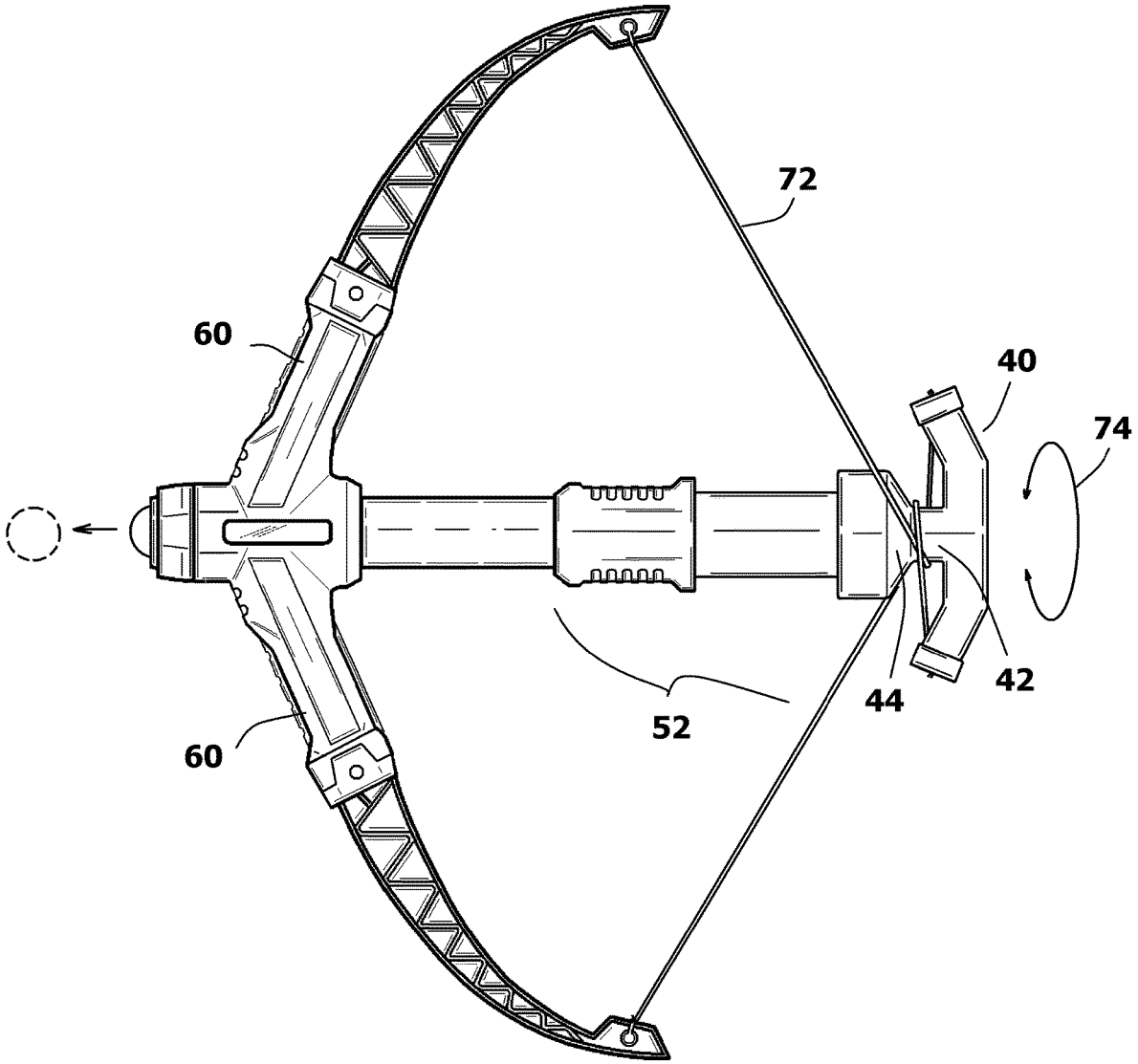
FIG. 5 shows the exemplary projectile launcher in a cocked configuration and a wound handle.

Conversely, the elastic bow string 72 can be used to selectively supplement the movement of the slide subassembly 52. Referring to FIG. 5 in conjunction with FIG. 2, it can be seen that the arms 60 of the bow structure 54 can be opened and locked in their extended configurations. This pulls the elastic bow string 72 into tension throughout the operational movement of the slide subassembly 52. The tension in the elastic bow string 72 can be selectively increased. As has been previously stated, the T-handle construct 40 is free to rotate relative the slide tube 30 as the slide tube 30 reciprocally moves along the launch tube 14. If the T-handle construct 40 is rotated in the directions of arrow 74, then the elastic bow string 72 begins to wind around the neck 42 of the T-handle construct 40. As the elastic bow string 72 winds on the neck 42, the tension in the elastic bow string 72 increases in proportion to the number of windings. The tension in the elastic bow string 72 can therefore be selectively controlled by selectively turning the T-handle construct 40. The beveled surface 44 at the base of the neck 42 keeps the wound elastic bow string 72 directed toward the arms 60. The smoothness of the beveled surface 44 prevents the wound elastic bow string 72 from binding.

When the T-handle construct 40 is released, the tensioned elastic bow string 72 moves the slide subassembly 52 with increased force. The tension of the released elastic bow string 72 also causes the T-handle construct 40 to rotate as the elastic bow string 72 unwinds. The rotation of the T-handle construct 40 has no effect on the pneumatic forces created by the lateral movement of the slide subassembly 52.

It will be understood that the embodiments of the present invention that are illustrated and described are merely exemplary and that a person skilled in the art can make many variations to those embodiments. For instance, the length, width and shape of the launch assembly can be changed to accommodate different sized balls. All such embodiments are intended to be included within the scope of the present invention as defined by the claims.

What is claimed is:

1. A toy projectile launcher, comprising:

a launch tube;

a slide tube having a first end and an opposite second end, wherein said slide tube engages said launch tube in a telescoping manner, and wherein relative movement of said slide tube and said launch tube creates a change of air pressure within said launch tube;

a handle construct affixed to said slide tube, said handle construct having a base that seals said second end of said slide tube, a tubular handle having a string conduit extending therethrough, and a narrowed neck that extends from said base to said tubular handle, wherein said handle construct is free to rotate relative said launch tube;

a bow structure affixed to said launch tube, wherein said bow structure has opposing arms that extend away from said launch tube; and an elastic bow string that extends between said opposing arms, wherein said elastic bow string extend through said string conduit in said tubular handle, and wherein said tubular handle winds said elastic bow string around said neck when said handle construct rotates relative to said launch tube.

2. The toy projectile launcher according to claim 1, wherein said tubular handle is free to rotate relative said slide tube.

3. The toy projectile launcher according to claim 1, further including a second handle that is rigidly affixed to said slide tube.

4. The toy projectile launcher according to claim 3, wherein said second handle is disposed on said slide tube at said first end.

5. The toy projectile launcher according to claim 1, wherein each of said opposing arms is configurable between an extended position and a folded position, wherein said elastic bow string is slack when each of said arms is in said folded position.

6. The toy projectile launcher according to claim 5, wherein each of said opposing arms has a first section and a second section that are connected at a hinge joint, wherein said first section and said second section move about said hinge joint between said extended position and said folded position.

7. The toy projectile launcher according to claim 6, further including a lock for selectively locking each of said arms in said extended position.

8. The toy projectile launcher according to claim 1, wherein said bow structure has a core section that surrounds a portion of said launch tube, wherein a window is formed within said core section that enables said launch tube within said bow structure to be viewed.

9. A toy projectile launcher, comprising:

a launch tube;

a slide tube having a first end and an opposite second end, wherein said slide tube engages said launch tube in a telescoping manner;

a handle, wherein said handle is free to rotate relative said launch tube;

a neck connecting said handle to said second end of said slide tube a bow structure affixed to said launch tube, wherein said bow structure has opposing arms that extend away from said launch tube; and at least one elastic bow string that extends between said handle and each of said opposing arms, wherein said elastic bow string biases said slide tube toward said launch tube, and wherein said elastic bow string winds about said neck when said handle rotates relative said launch tube.

10. The toy projectile launcher according to claim 9, wherein said handle is free to rotate relative said slide tube.

11. The toy projectile launcher according to claim 9, further including a second handle that is rigidly affixed to said slide tube.

12. The toy projectile launcher according to claim 11, wherein said second handle is disposed on said slide tube at said first end.

13. The toy projectile launcher according to claim 9, wherein each of said opposing arms is configurable between an extended position and a folded position, wherein said elastic bow string is slack when each of said arms is in said folded position.

14. The toy projectile launcher according to claim 13, wherein each of said opposing arms has a first section and a second section that are connected at a hinge joint, wherein said first section and said second section move about said hinge joint between said extended position and said folded position.

15. The toy projectile launcher according to claim 14, further including a lock for selectively locking each of said arms in said extended position.

16. The toy projectile launcher according to claim 9, wherein said opposing arms are part of a bow structure that is affixed to said launch tube.

17. The toy projectile launcher according to claim 16, wherein said bow structure has a core section that surrounds a portion of said launch tube, wherein a window is formed within said core section that enables said launch tube within said bow structure to be viewed.

18. A toy projectile launcher, comprising:

a launch tube having a first end and an opposite second, wherein said second end terminates with a vented stop;

a bow structure affixed to said launch tube, wherein said bow structure has opposing arms that extend away from said launch tube;

a slide tube having an open end and an opposite closed end, wherein said open end of said slide tube receives said second end of said launch tube, wherein said launch tube passes into said slide tube in a telescoping manner, and wherein relative movement of said slide tube and said launch tube creates a change of air pressure within said launch tube;

a first handle affixed to said slide tube that seals said closed end of said slide tube;

a second handle affixed slide tube adjacent said first end; and at least one elastic bow string that extends from said opposing arms and engage said first handle, wherein said at least one elastic bow string biases said slide tube toward said launch tube.

* * * * *